US007100314B1

(12) United States Patent
Jensen

(10) Patent No.: US 7,100,314 B1
(45) Date of Patent: Sep. 5, 2006

(54) PLOW BLADE FLOAT ATTACHMENT

(76) Inventor: Leland E. Jensen, 2947 Tyler Pkwy., Bismarck, ND (US) 58503

( * ) Notice: Subject to any disclaimer, the term of this patent is extended or adjusted under 35 U.S.C. 154(b) by 118 days.

(21) Appl. No.: 10/862,133

(22) Filed: Jun. 5, 2004

(51) Int. Cl.
*E01H 5/04* (2006.01)

(52) U.S. Cl. ..... 37/281; 37/231; 172/816; 404/104

(58) Field of Classification Search ..... 37/232, 37/266, 281, 283, 219, 272–274, 229; 172/816, 172/265, 269; 404/101, 104
See application file for complete search history.

(56) References Cited

U.S. PATENT DOCUMENTS

| | | | | |
|---|---|---|---|---|
| 2,085,996 | A | 7/1937 | Phillips | 37/42 |
| 2,218,512 | A | 10/1940 | Ball | 37/42 |
| 3,208,166 | A | 9/1965 | Proulx | 37/42 |
| 3,231,991 | A | 2/1966 | Wandscheer et al. | 37/42 |
| 3,279,104 | A * | 10/1966 | Wandscheer et al. | 37/280 |
| 3,373,515 | A | 3/1968 | Schneider | 37/50 |
| 3,374,562 | A | 3/1968 | Glesmann | 37/50 |
| 3,407,519 | A | 10/1968 | Batko | 37/42 |
| 3,477,151 | A | 11/1969 | Zanella | 37/42 |
| 3,604,517 | A | 9/1971 | Clifford | 172/225 |
| 3,680,451 | A * | 8/1972 | Birtchet | 404/104 |
| 4,077,139 | A * | 3/1978 | Fagervold et al. | 37/280 |
| 4,145,825 | A | 3/1979 | Bertolino | 37/42 |
| 4,208,812 | A | 6/1980 | Brownly | 37/41 |
| 4,217,707 | A | 8/1980 | Karlsson | 37/41 |
| 4,372,617 | A * | 2/1983 | Zamboni | 299/24 |
| 4,446,639 | A | 5/1984 | Bohn | 37/280 |
| 4,479,312 | A | 10/1984 | Turgeon | 37/219 |
| 4,491,275 | A | 1/1985 | Holsworth | 239/663 |
| 4,614,048 | A | 9/1986 | Melby | 37/280 |
| 4,890,400 | A | 1/1990 | Long | 37/117.5 |
| 5,285,588 | A | 2/1994 | Niemela et al. | 37/234 |
| 5,344,254 | A * | 9/1994 | Sartain | 404/104 |
| 5,375,349 | A | 12/1994 | Jochim | 37/429 |
| 5,409,068 | A | 4/1995 | Hake et al. | 172/196 |
| 5,509,219 | A | 4/1996 | Mecca | 37/231 |
| 5,758,728 | A | 6/1998 | Ragule | 172/815 |
| 5,802,361 | A | 9/1998 | Wang et al. | 395/600 |
| 5,819,288 | A | 10/1998 | De Bonet | 707/104 |
| 5,860,230 | A | 1/1999 | Daniels | 37/232 |
| 5,899,007 | A | 5/1999 | Niemela et al. | 37/281 |
| 6,009,642 | A | 1/2000 | Nugent | 37/231 |
| 6,347,465 | B1 | 2/2002 | Jensen | 37/280 |
| 6,523,620 | B1 * | 2/2003 | Burson | 172/815 |
| 6,751,894 | B1 * | 6/2004 | Verseef | 37/266 |

* cited by examiner

*Primary Examiner*—Thomas A Beach

(57) ABSTRACT

A plow blade float attachment for preventing damage to a side deflector on a plow blade. The plow blade float attachment includes an arm member pivotally attached to a deflector member of a plow blade, a contact member attached to the arm member, a guide member attached to the deflector member for slidably receiving a distal portion of the arm member, and a bias member attached between the deflector member and the arm member for applying a downward bias force to the arm member.

20 Claims, 6 Drawing Sheets

PLOW BLADE FLOAT ATTACHMENT

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to plow blade deflectors and more specifically it relates to a plow blade float attachment for preventing damage to a side deflector on a plow blade.

2. Description of the Related Art

Plow blades have been in use for years upon tractors, road graders, trucks and the like vehicles. A plow blade is typically comprised of an elongated structure having a lower blade edge for engaging material such as snow, ice dirt or gravel. The blade can also typically be raised, lowered, tilted and pivoted to allow for control of the flow of material.

Recently, plow blade improvements have included a side deflector member that is movably attached to one end of the plow blade for allowing the plow blade operator to reduce the size of windrows thrown to the side of the plow blade (e.g. by driveways). U.S. Pat. No. 6,347,465 to Leland E. Jensen teaches an exemplary side deflector member and is hereby incorporated by reference into this application.

While side deflector members for plow blades are suitable for reducing the size of thrown windrows, they are sometimes susceptible to damage. For example, if the plow blade encounters an obstacle in the plow path that the side deflector member engages first, the side deflector member will be raised upwardly with respect to the plow blade resulting in possible damage to the side deflector member (and possibly the plow blade). Another situation involves where the plow blade is rotated fore which will result in the forwardly extended side deflector member being forced into the ground surface.

While plow blade deflector devices are suitable for the particular purpose to which they address, they are susceptible to damage caused by encountering obstacles and movements of the plow blade. In these respects, the plow blade float attachment according to the present invention substantially departs from the conventional concepts and designs of the prior art, and in so doing provides an apparatus primarily developed for the purpose of preventing damage to a side deflector on a plow blade.

BRIEF SUMMARY OF THE INVENTION

In view of the foregoing disadvantages inherent in the known types of plow blade deflectors now present in the prior art, the present invention provides a new plow blade float attachment construction wherein the same can be utilized for preventing damage to a side deflector on a plow blade.

The general purpose of the present invention, which will be described subsequently in greater detail, is to provide a new plow blade float attachment that has many of the advantages of the plow blade deflectors mentioned heretofore and many novel features that result in a new plow blade float attachment which is not anticipated, rendered obvious, suggested, or even implied by any of the prior art plow blades, either alone or in any combination thereof.

To attain this, the present invention generally comprises an arm member pivotally attached to a deflector member of a plow blade, a contact member attached to the arm member, a guide member attached to the deflector member for slidably receiving a distal portion of the arm member, and a bias member attached between the deflector member and the arm member for applying a downward bias force to the arm member.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a plow blade float attachment that will overcome the shortcomings of the prior art devices.

A second object is to provide a plow blade float attachment for preventing damage to a side deflector on a plow blade.

Another object is to provide a plow blade float attachment that may be utilized upon various types of plow blade deflectors.

An additional object is to provide a plow blade float attachment that maintains constant road contact despite the terrain or movements of the plow blade.

A further object is to provide a plow blade float attachment that allows the plow blade to be operated at various pitches.

Another object is to provide a plow blade float attachment that reduces the wear on a road contact member.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
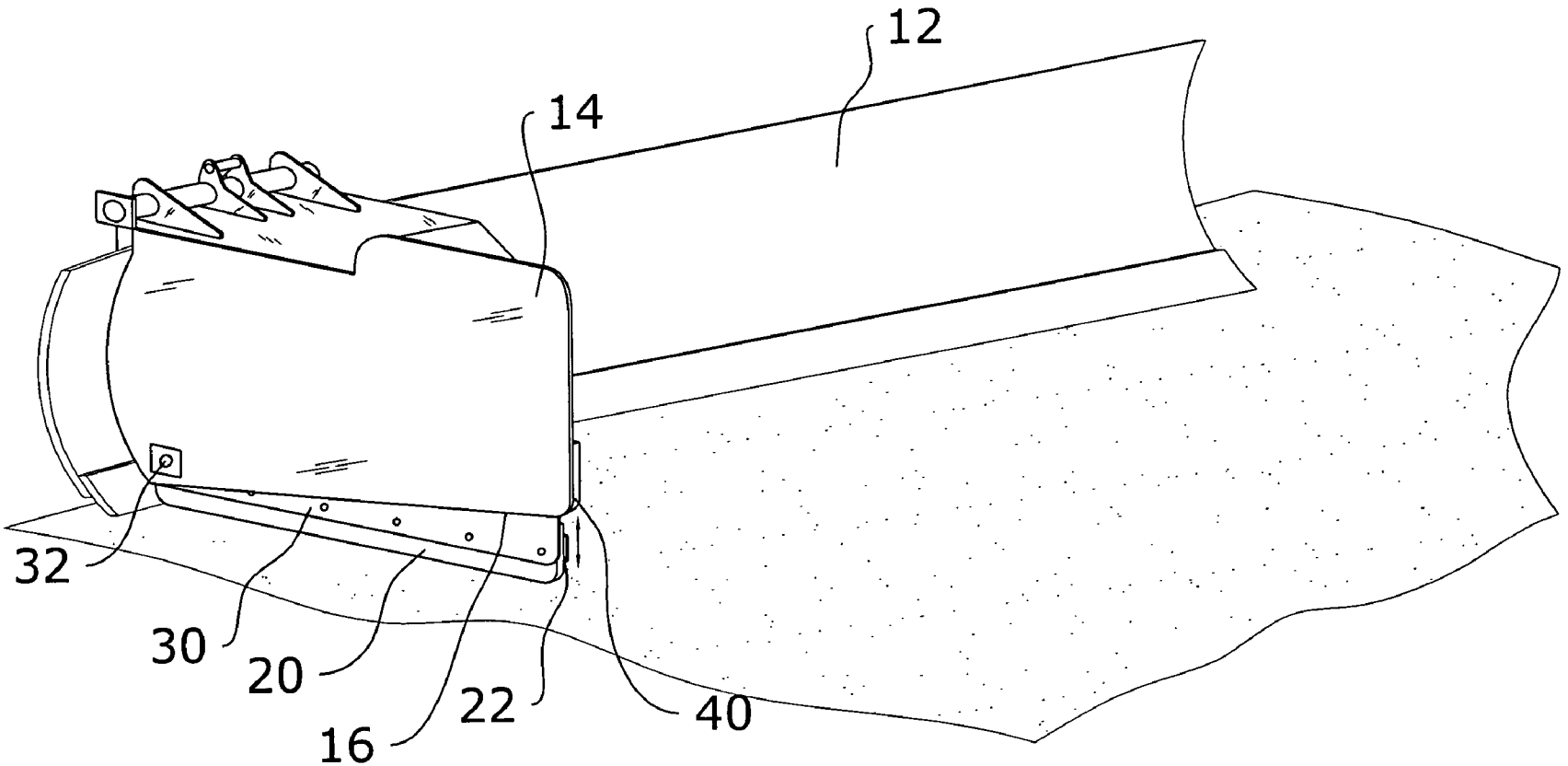
FIG. 1 is an upper perspective view of the present invention attached to a deflector member.

Turning now descriptively to the drawings, in which similar reference characters denote similar elements throughout the several views, FIGS. 1 through 6 illustrate a plow blade float attachment 10, which comprises an arm member 30 pivotally attached to a deflector member 14 of a plow blade 12, a contact member 20 attached to the arm member 30, a guide member 40 attached to the deflector member 14 for slidably receiving a distal portion of the arm member 30, and a bias member 50 attached between the deflector member 14 and the arm member 30 for applying a downward bias force to the arm member 30.

B. Deflector Member

Figure 2:
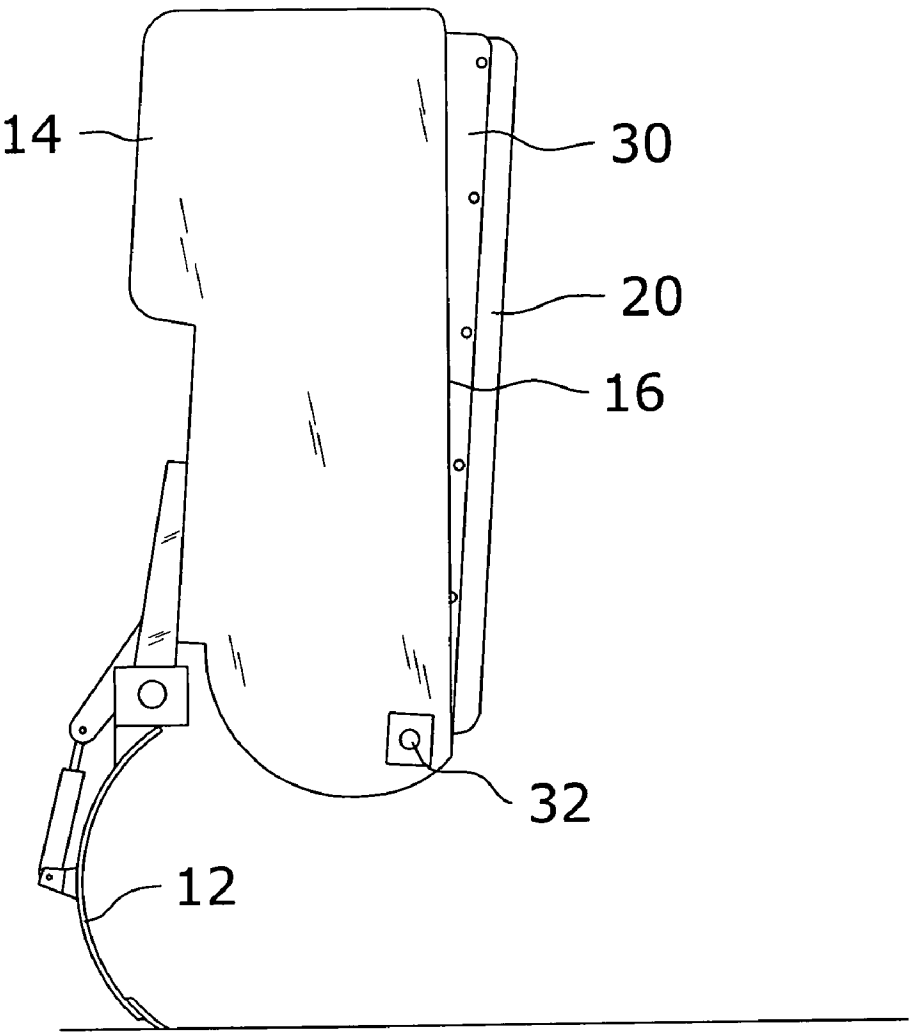
FIG. 2 is a side view of the present invention attached to a deflector member in the raised position.
Figure 3:
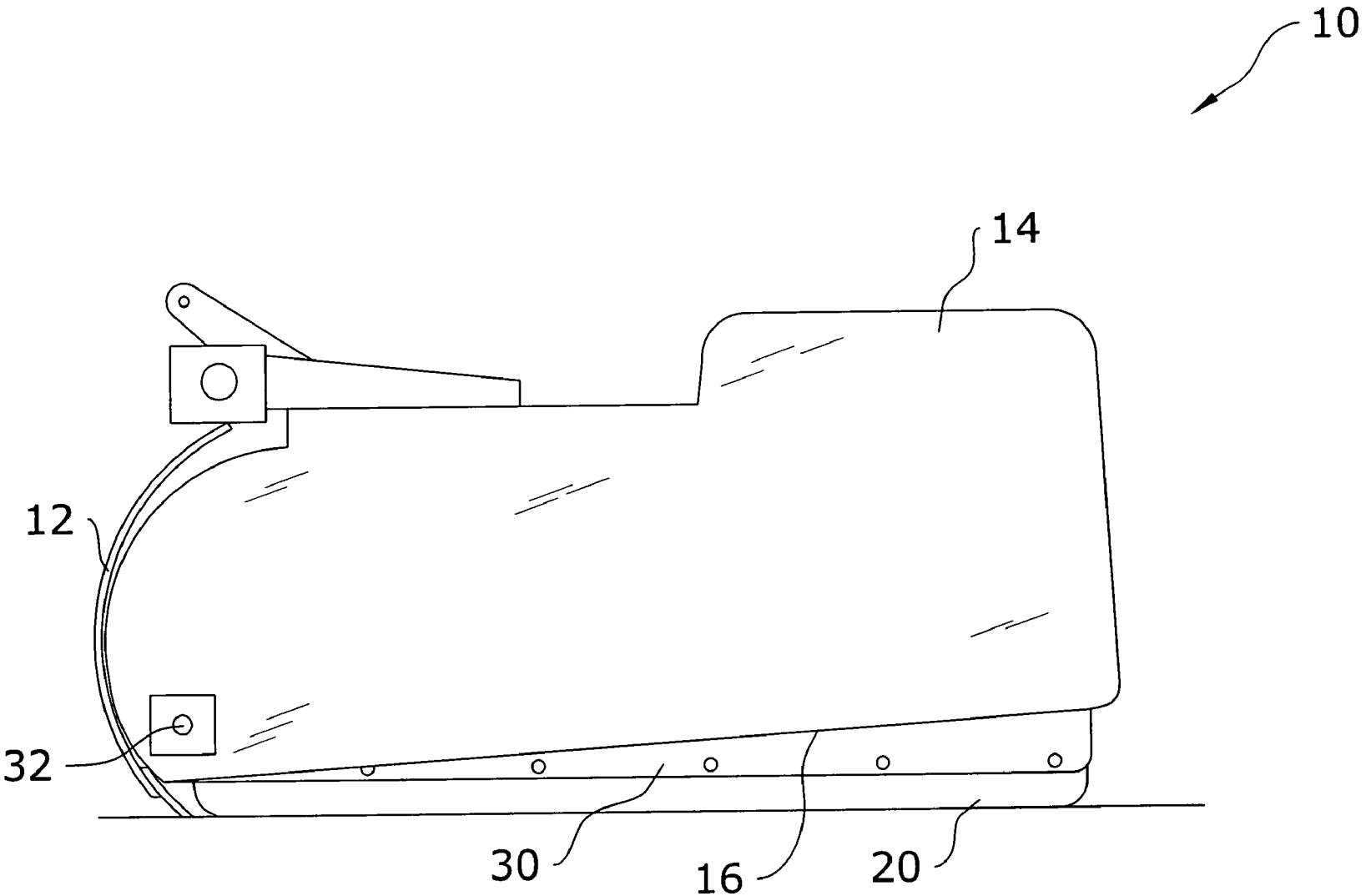
FIG. 3 is a side view of the present invention attached to a deflector member in the lowered position.

FIGS. 1 through 3 illustrate an exemplary deflector member 14 attached to a plow blade 12. U.S. Pat. No. 6,347,465 issued to Leland E. Jensen is hereby incorporated by reference for the purpose of disclosing a suitable deflector member 14, deflector member 14 attachment and support structure, plow blade 12 and contact member 20. The deflector member 14 may be comprised of various other structures and configurations attachable to an end of a plow blade 12.

The deflector member 14 preferably has a lower edge 16 that is angled upwardly extending toward a front of the deflector member 14 as best illustrated in FIGS. 2 and 3 of the drawings. The angle of the lower edge 16 is preferably parallel to a radial position of the arm member 30 when the arm member 30 is raised.

C. Arm Member

The arm member 30 has a rear portion pivotally attached to the deflector member 14 by a pivot pin 32 or other suitable attachment mechanism. The arm member 30 is preferably substantially parallel with respect to the deflector member 14 so as to be aligned with the plow path of the plow blade 12. The arm member 30 may be comprised of various reinforced configurations capable of withstanding the impacts encountered by a plow blade 12 during operation.

D. Bias Member

Figure 4:
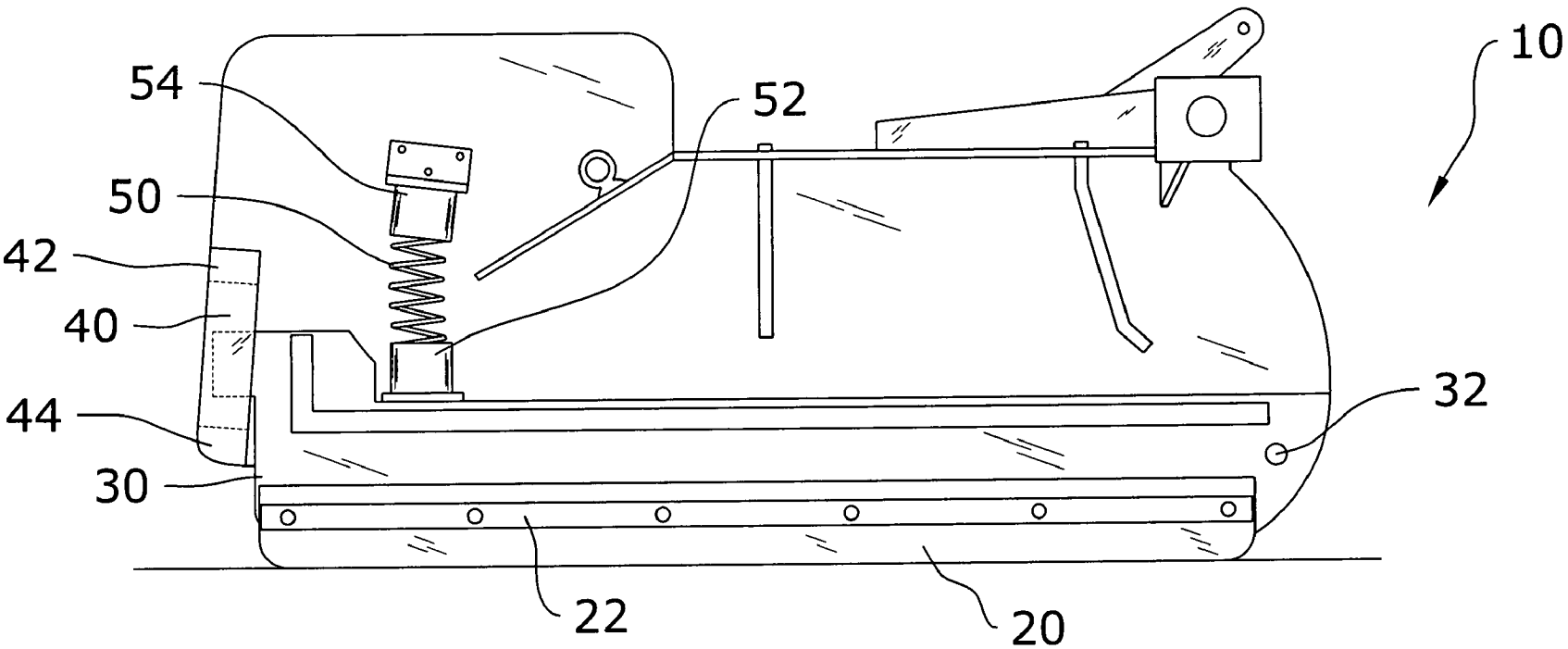
FIG. 4 is an opposite side view of the present invention attached to a deflector member in the lowered position.
Figure 6:
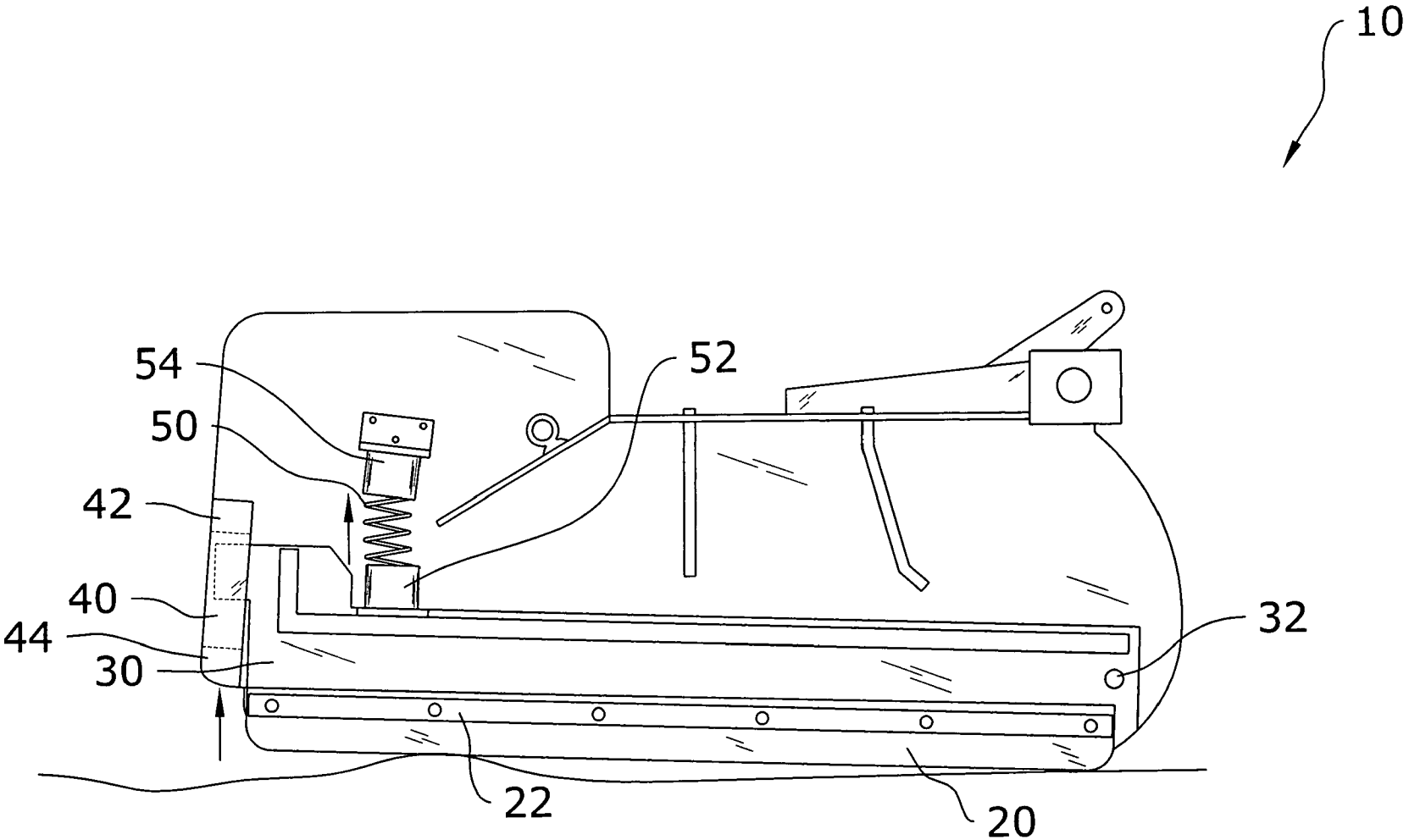
FIG. 6 is an opposite side view of the present invention engaging the object within a plow path.

The bias member 50 is attached between the deflector member 14 and the arm member 30 for applying a downward bias force to the arm member 30. The bias member 50 is preferably comprised of a compression spring as shown in FIGS. 4 and 6 of the drawings. However, the bias member 50 may be comprised of other biasing devices (e.g. shocks, etc.).

As further shown in FIGS. 4 and 6 of the drawings, a lower member 52 is preferably attached to the arm member 30 and an upper member 54 is attached to the deflector member 14. The lower member 52 and the upper member 54 are preferably comprised of a tubular structure for receiving the distal ends of the bias member 50 respectively. The upper member 54 and the lower member 52 may be comprised of various other bracket structures.

E. Contact Member

The contact member 20 is preferably removably attached to the arm member 30 as shown in FIGS. 1 through 6 of the drawings. The contact member 20 is designed for engaging the plow surface (e.g. road surface). The contact member 20 may be comprised of various types of materials such as but not limited to rubber, plastic, metal, wood and the like. The contact member 20 may be retained upon the arm member 30 by a reinforcing member 22 on the opposite side of the contact member 20 as shown in FIGS. 4 and 6 of the drawings.

F. Guide Member

The guide member 40 is attached to the deflector member 14 for slidably receiving a front portion of the arm member 30 as best illustrated in FIGS. 4 and 6 of the drawings. A slot is formed between the guide member 40 and the deflector member 14 for receiving the front portion of the arm member 30. The slot may also be directly formed within the guide member 40. The front portion of the arm member 30 is partially received within the slot defined by the guide member 40 and the arm member 30 is allowed to freely pivot about the pivot pin 32.

As shown in FIGS. 4 and 6 of the drawings, the guide member 40 further preferably includes an upper stopper 42 and a lower stopper 44 to limit the movement of the arm member 30 within the slot of the guide member 40. The stoppers 42, 44 may be comprised of various structures that limit the movement range of the arm member 30.

G. Operation of Invention

In use, the deflector member 14 is in a raised position when not in use as shown in FIG. 2 of the drawings. When the plow operator desires to reduce the windrow size, the deflector member 14 is lowered so that the contact member 20 is in contact with the ground surface as shown in FIGS. 1, 3 and 4 of the drawings.

Figure 5:
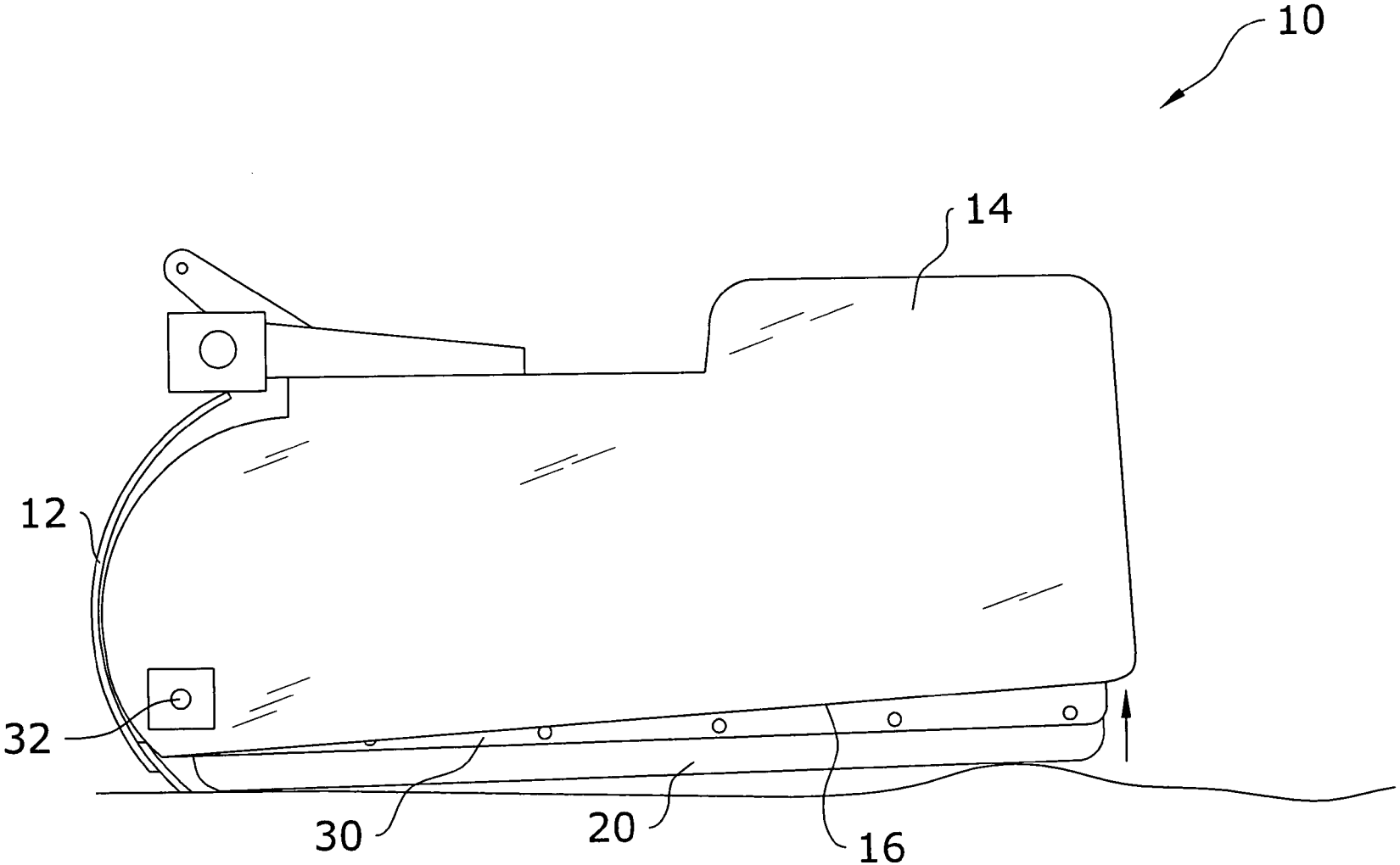
FIG. 5 is a side view of the present invention engaging an object within a plow path.

As the plow blade 12 is moved forwardly, the contact member 20 may engage an obstacle as shown in FIGS. 5 and 6 of the drawings. As best illustrated in FIG. 6, the arm member 30 is thereby pivoted about the pivot pin 32 upwardly and thereby compresses the bias member 50. The upward movement of the arm member 30 with respect to the deflector member 14 allows the plow blade 12 and deflector member 14 to remain in a steady position without damage occurring to the deflector member 14. As the arm member 30 moves upwardly, the front portion is slidably moving within the slot of the guide member 40 thereby maintaining the arm member 30 in a desired position at all times. When the contact member 20 passes over the obstacle, the arm member 30 is returned to a lowered position as shown in FIGS. 3 and 4 of the drawings. The same process occurs when the plow blade 12 is rotated forwardly or rearwardly.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A plow blade float attachment, comprising:

a deflector member attached to a first side of a plow blade, wherein said deflector member is substantially transverse with respect to said plow blade;

an arm member having a rear portion pivotally attached to said deflector member;

a bias member attached between said deflector member and said arm member for applying a downward bias force to said arm member; and a contact member attached to said arm member.

2. The plow blade float attachment of claim 1, including a guide member attached to said deflector member for slidably receiving a front portion of said arm member.

3. The plow blade float attachment of claim 2, wherein a slot is formed between said guide member and said deflector member for receiving said front portion of said arm member.

4. The plow blade float attachment of claim 1, wherein said bias member is comprised of a compression spring.

5. The plow blade float attachment of claim 1, including a lower member attached to said arm member and an upper member attached to said deflector member, wherein said bias member is attached between said lower member and said upper member.

6. The plow blade float attachment of claim 5, wherein said lower member and said upper member are comprised of a tubular structure.

7. The plow blade float attachment of claim 6, wherein said bias member is comprised of a compression spring.

8. The plow blade float attachment of claim 1, wherein said arm member is substantially parallel with respect to said deflector member.

9. The plow blade float attachment of claim 1, wherein said deflector member has a lower edge that is angled upwardly extending toward a front of said deflector member.

10. The plow blade float attachment of claim 1, a guide member attached to said deflector member, wherein said guide member includes an upper stopper and a lower stopper to limit the movement of the arm member.

11. A plow blade float attachment, comprising:

a deflector member attachable to a plow blade, wherein said deflector member has a lower edge that is angled upwardly extending toward a front of said deflector member;

an arm member having a rear portion pivotally attached to said deflector member, wherein said arm member is substantially parallel with respect to said deflector member;

a bias member attached between said deflector member and said arm member for applying a downward bias force to said arm member, wherein said bias member is comprised of a compression spring;

a lower member attached to said arm member;

an upper member attached to said deflector member, wherein said lower member and said upper member are comprised of a tubular structure and wherein said bias member is attached between said lower member and said upper member;

a contact member attached to said arm member; and a guide member attached to said deflector member for slidably receiving a front portion of said arm member, wherein a slot is formed between said guide member and said deflector member for receiving said front portion of said arm member and wherein said guide member includes an upper stopper and a lower stopper to limit the movement of the arm member.

12. A plow blade float attachment, comprising:

a deflector member attachable to a plow blade;

an arm member having a rear portion pivotally attached to said deflector member;

a bias member attached between said deflector member and said arm member for applying a downward bias force to said arm member;

a contact member attached to said arm member;

a guide member attached to said deflector member, wherein said guide member includes an upper stopper and a lower stopper to limit the movement of the arm member.

13. The plow blade float attachment of claim 12, wherein said guide member slidably receives a front portion of said arm member.

14. The plow blade float attachment of claim 12, wherein a slot is formed between said guide member and said deflector member for receiving said front portion of said arm member.

15. A plow blade float attachment, comprising:

a deflector member attachable to a plow blade, wherein said deflector member has a lower edge that is angled upwardly extending toward a front of said deflector member;

an arm member having a rear portion pivotally attached to said deflector member;

a bias member attached between said deflector member and said arm member for applying a downward bias force to said arm member; and a contact member attached to said arm member.

16. The plow blade float attachment of claim 15, including a guide member attached to said deflector member for slidably receiving a front portion of said arm member.

17. The plow blade float attachment of claim 15, wherein said arm member is substantially parallel with respect to said deflector member.

18. The plow blade float attachment of claim 15, a guide member attached to said deflector member, wherein said guide member includes an upper stopper and a lower stopper to limit the movement of the arm member.

19. A plow blade float attachment, comprising:

a deflector member attachable to a plow blade;

an arm member having a rear portion pivotally attached to said deflector member;

a bias member attached between said deflector member and said arm member for applying a downward bias force to said arm member;

a contact member attached to said arm member;

a lower member attached to said arm member and an upper member attached to said deflector member, wherein said bias member is attached between said lower member and said upper member, and wherein said lower member and said upper member are comprised of a tubular structure.

20. The plow blade float attachment of claim 19, wherein said bias member is comprised of a compression spring.

* * * * *